US007717590B1

(12) United States Patent
Li

(10) Patent No.: US 7,717,590 B1
(45) Date of Patent: May 18, 2010

(54) LED LAMP WITH REFLECTING CASINGS

(76) Inventor: Chia-Mao Li, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 12/266,557

(22) Filed: Nov. 7, 2008

(51) Int. Cl.
*F21V 29/00* (2006.01)

(52) U.S. Cl. ..... 362/294; 362/249.02; 362/650

(58) Field of Classification Search ..... 362/227, 362/236, 238, 240, 241, 294, 297, 304, 341, 362/346, 347, 356, 373, 800; 165/80.3, 104.26, 165/104.33, 169

See application file for complete search history.

(56) References Cited

U.S. PATENT DOCUMENTS 7,610,947 B2 * 11/2009 Wang et al. ..... 165/80.3

* cited by examiner

*Primary Examiner*—Hargobind S Sawhney

(57) ABSTRACT

An LED lamp with reflecting casings comprises a bulb seat having an international standard joint at an outer side thereof; an interior of the bulb seat having a power supply; an insulating layer for isolating the power supply and an auxiliary heat dissipating casing; a main heat dissipating casing being a hollow tapered shape and being opened at two ends; the tapered size of the main heat dissipating casing being smaller than that of the auxiliary heat dissipating casing; an LED lamp body having a conductive metal heat sink with good conductivity at an upper side thereof; an inner supporting surface of the LED lamp body serving to install with at least one LED chip; the metal heat sink having a round shape and a rear end thereof protrudes with chip pins; and a heat conducting base for receive the LED lamp body.

3 Claims, 7 Drawing Sheets

LED LAMP WITH REFLECTING CASINGS

FIELD OF THE INVENTION

The present invention relates to LED lamps, in particular to an LED lamp with reflecting casings which has a main heat dissipating casing and at least one auxiliary heat dissipating casings. The present invention provides that the lamp has a conventional beautiful outlook and has a greater heat dissipation area so that the temperature of the lamp is reduced greatly. Furthermore, the cost is down and less material is used. further the lifetime of the LED lamp is prolonged.

BACKGROUND OF THE INVENTION

LED has widely used in many field due to small volume and power saving. However currently, LEDs have the problem of heat dissipation. This make the high power LED can not replace the convention illumination device effectively. The heat dissipation will increase with the increment of the temperature of the LED, while this will short the lifetime of the LED.

With reference to FIG. 1, the prior art lamp 10 has heat dissipation fins 100 for heat dissipation. The fins 100 are made of extrusion of aluminum sheet which has a heavy and large shape which is not match to the shape of the lamp. Thereby, the fins are expensive. To have preferred heat dissipation effect, it is necessary to increase the area and thus size of fins, but this will make the outlook of the lamp feel ugly and the manufacturing process is tedious and thus is expensive. Therefore, there is an eager demand for a novel design which can improve the defects in the prior art so as to provide a high heat dissipation LED lamp with smaller size.

SUMMARY OF THE INVENTION

Accordingly the object of the present invention is to provide an LED lamp with reflecting casings; comprising: a bulb seat having an international standard joint at an outer side thereof; an interior of the bulb seat having a power supply; an insulating layer for isolating the power supply and an auxiliary heat dissipating casing; the bulb seat having a plurality of hollow posts and the wires connected to a circuit board and protruding outwards; the auxiliary heat dissipating casing having a hollow tapered shape which is opened at two ends; a lower opening of the auxiliary heat dissipating casing being enclosed by an inward edge; the inward edge being formed with a plurality of connecting holes; a main heat dissipating casing being a hollow tapered shape and being opened at two ends; the tapered size of the main heat dissipating casing being smaller than that of the auxiliary heat dissipating casing; an upper opening of the main heat dissipating casing having a third inward edge which is formed with a plurality of second connecting holes; an LED lamp body having a conductive metal heat sink with good conductivity at an upper side thereof; an inner supporting surface of the LED lamp body serving to install with at least one LED chip; the metal heat sink having a round shape and a rear end thereof protrudes with chip pins; and a heat conducting base for receive the LED lamp body; the heat conducting base having a plurality of connecting holes; a center of the heat conducting base being installed with a round recess; and the recess being installed with a plurality of pin holes so that the chip pins can be installed to a rear end of the heat conducting base.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
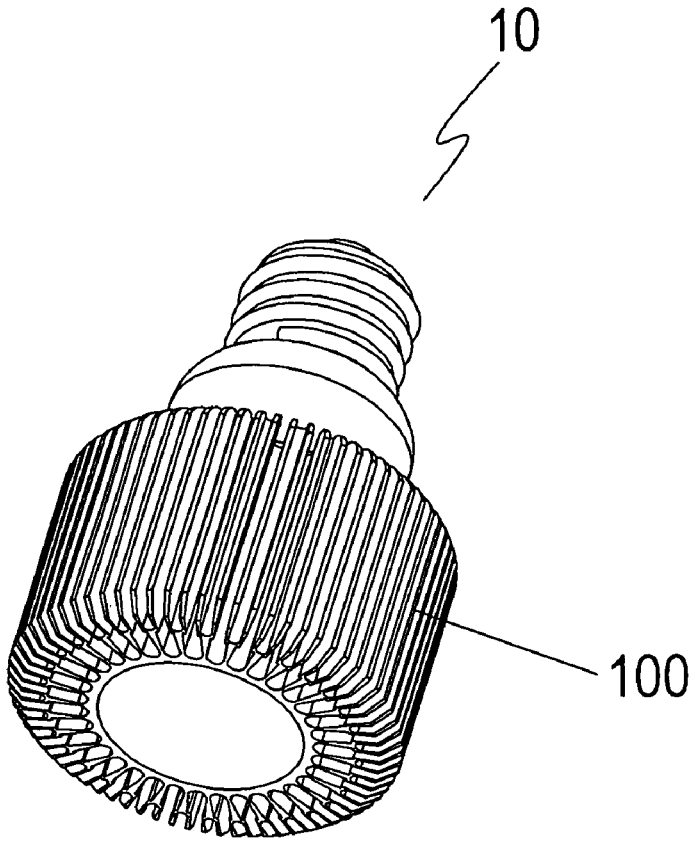
Fig. 1 (PRIOR ART)
FIG. 1 is a perspective view of the prior art lamp.
Figure 2:
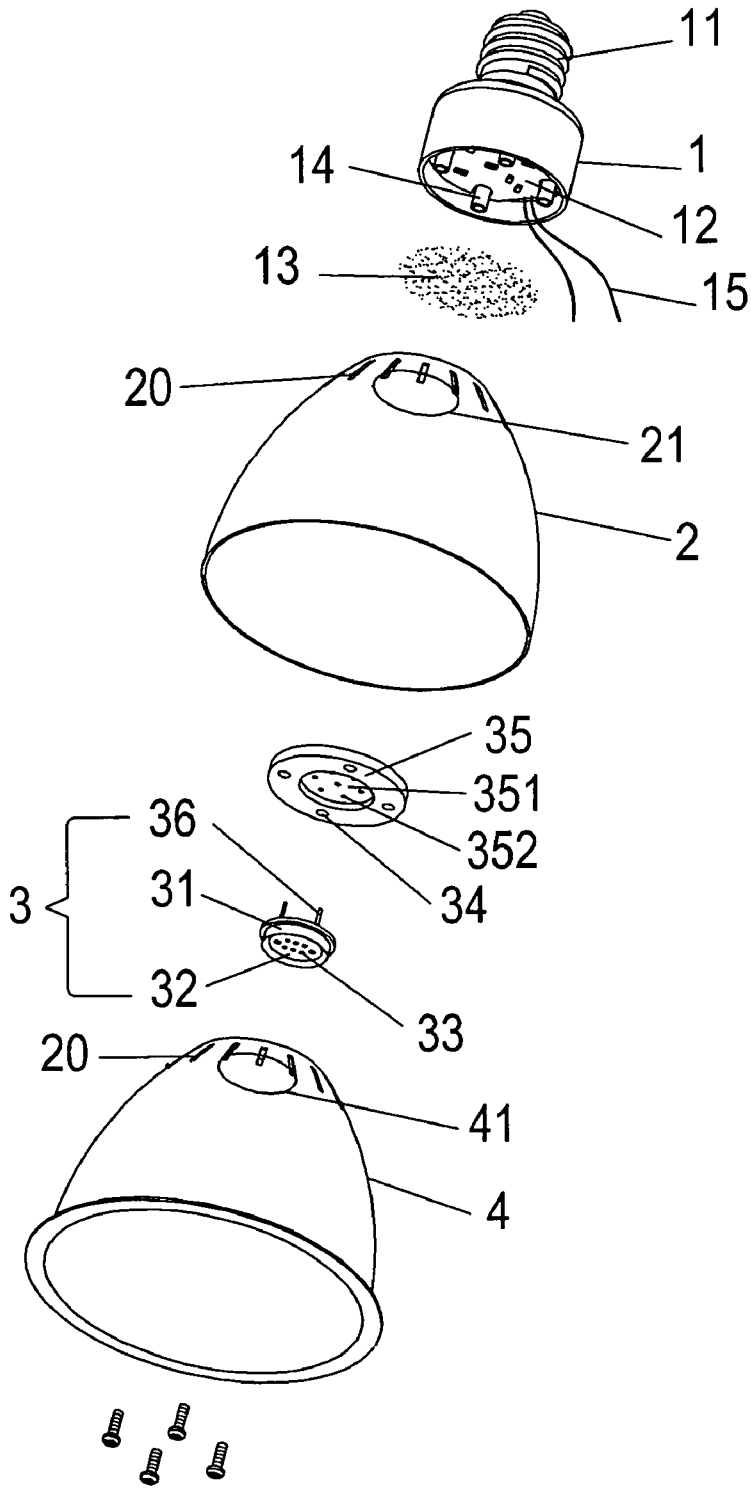
FIG. 2 is an exploded perspective view of the present invention.
Figure 3:
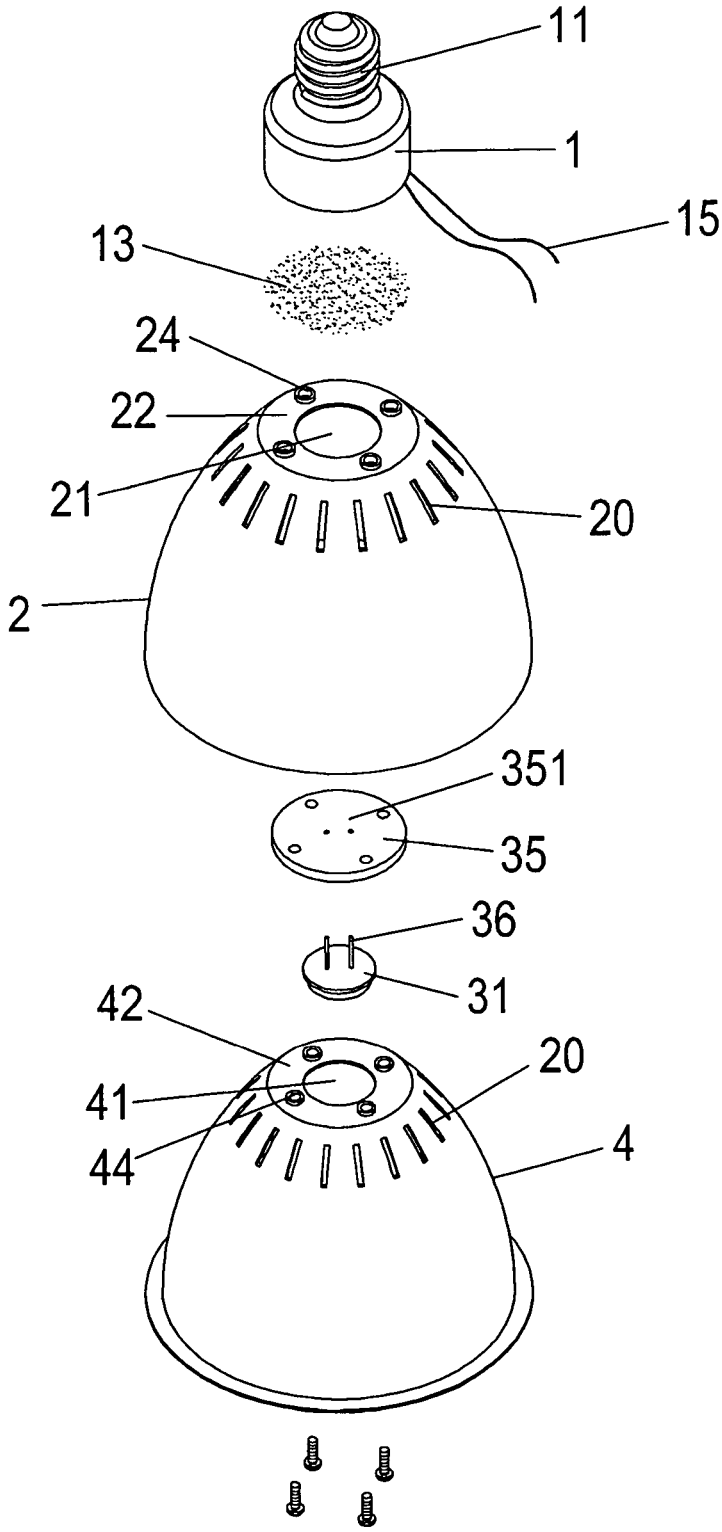
FIG. 3 is an exploded perspective view of the present invention which is viewed from another direction.

Referring to FIGS. 2 and 3, the structure of the present invention is illustrated. The present invention has the following elements. A bulb seat 1 has an international standard joint 11 at an outer side thereof. An interior of the bulb seat 1 has a power supply 12. An insulating layer 13 serves to isolate the power supply 12 and an auxiliary heat dissipating casing 2. The bulb seat 1 has a plurality of hollow posts 14 and the wires connected to a circuit board and protruding outwards.

The auxiliary heat dissipating casing 2 has a hollow tapered shape which is opened at two ends. A lower opening 21 of the auxiliary heat dissipating casing 2 is enclosed by an inward edge 22. The inward edge 22 is formed with a plurality of connecting holes 24.

A main heat dissipating casing 4 is a hollow tapered shape and is opened at two ends. The tapered size of the main heat dissipating casing 4 is smaller than that of the auxiliary heat dissipating casing 2. An upper opening 41 of the main heat dissipating casing 4 has a third inward edge 42 which is formed with a plurality of second connecting holes 44.

An LED lamp body 3 has a conductive metal heat sink 31 with good conductivity at an upper side thereof. An inner supporting surface 32 of the LED lamp body 3 serves to install with at least one LED (light emitting diode) chip 33. The metal heat sink 31 may has a round shape and a rear end thereof protrudes with chip pins 36.

A heat conducting base 35 serves to receive the LED lamp body 3. The heat conducting base 35 has plurality of connecting holes 34. A center of the heat conducting base 35 is installed with a round recess 351. The recess 351 is installed with a plurality of pin holes 352 so that the chip 33 can be firmed secured to a rear end of the heat conducting base 35.

Figure 4:
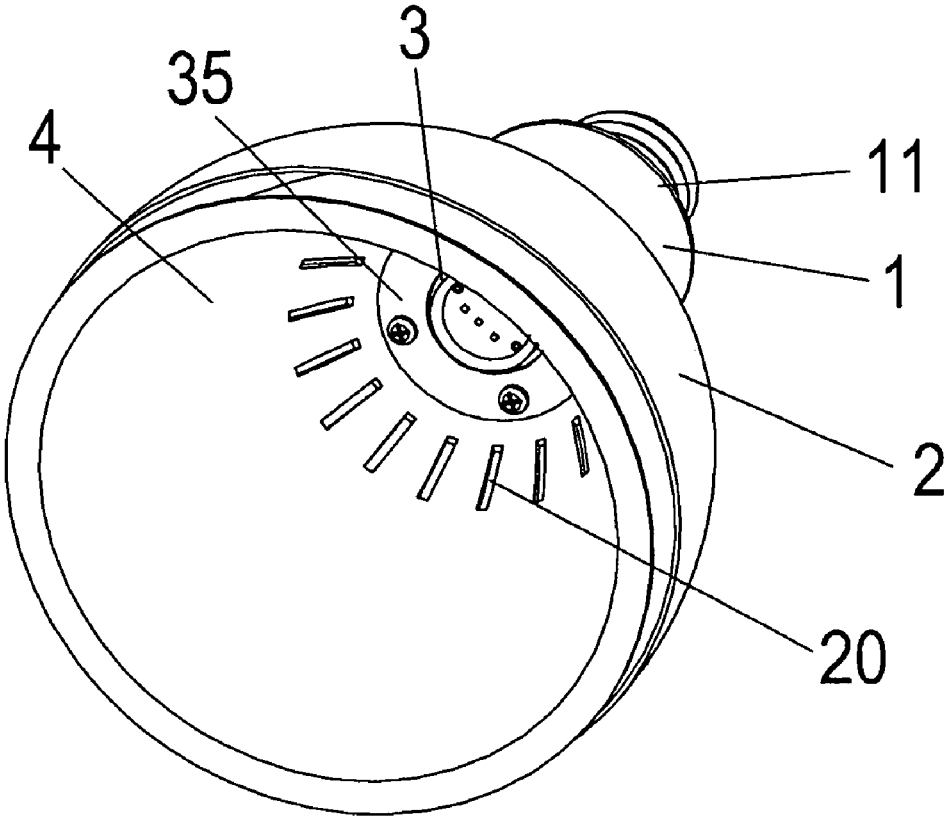
FIG. 4 is an assembled perspective view of the present invention.
Figure 5:
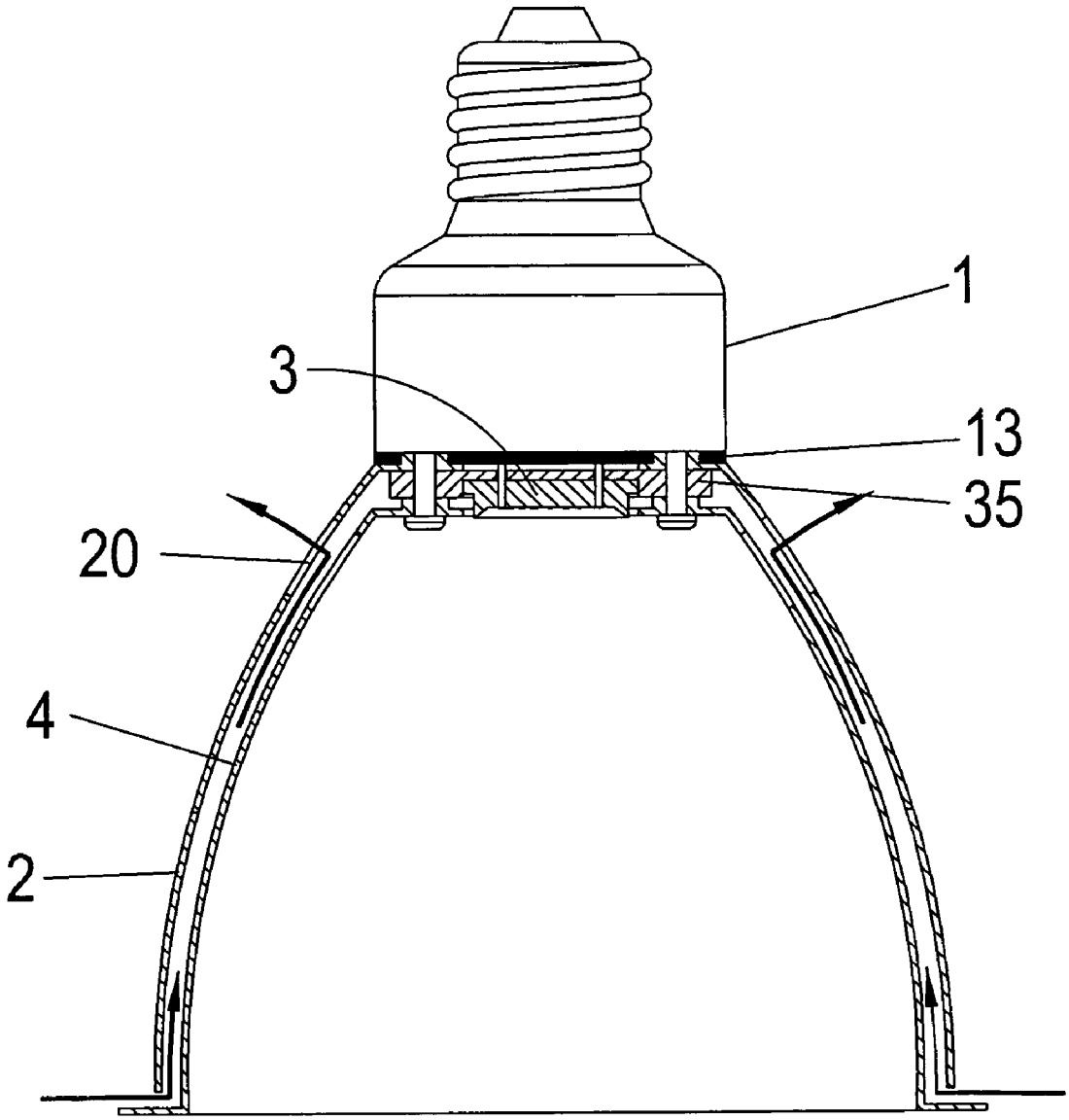
FIG. 5 is an assembled cross sectional view of the present invention.

Referring to FIGS. 4 and 5, in the present invention, the main heat dissipating casing 4 has the function of dispersing light to have a desired light shape. Furthermore, the main heat dissipating casing 4 and the through holes 20 of the auxiliary heat dissipating casing 2 will cause that the heat from the LED lamp body 3 is transferred to the main heat dissipating casing 4 and the auxiliary heat dissipating casing 2. Then the heat is further dissipated through the main heat dissipating casing 4 and the auxiliary heat dissipating casing 2 so as to have a great heat dissipation area and has the effect of multilayer heat dissipation effect. No heat is accumulated and the heating effect of the LED lamp body 3 is increased. The lifetime of the lamp is prolonged.

Figure 6:
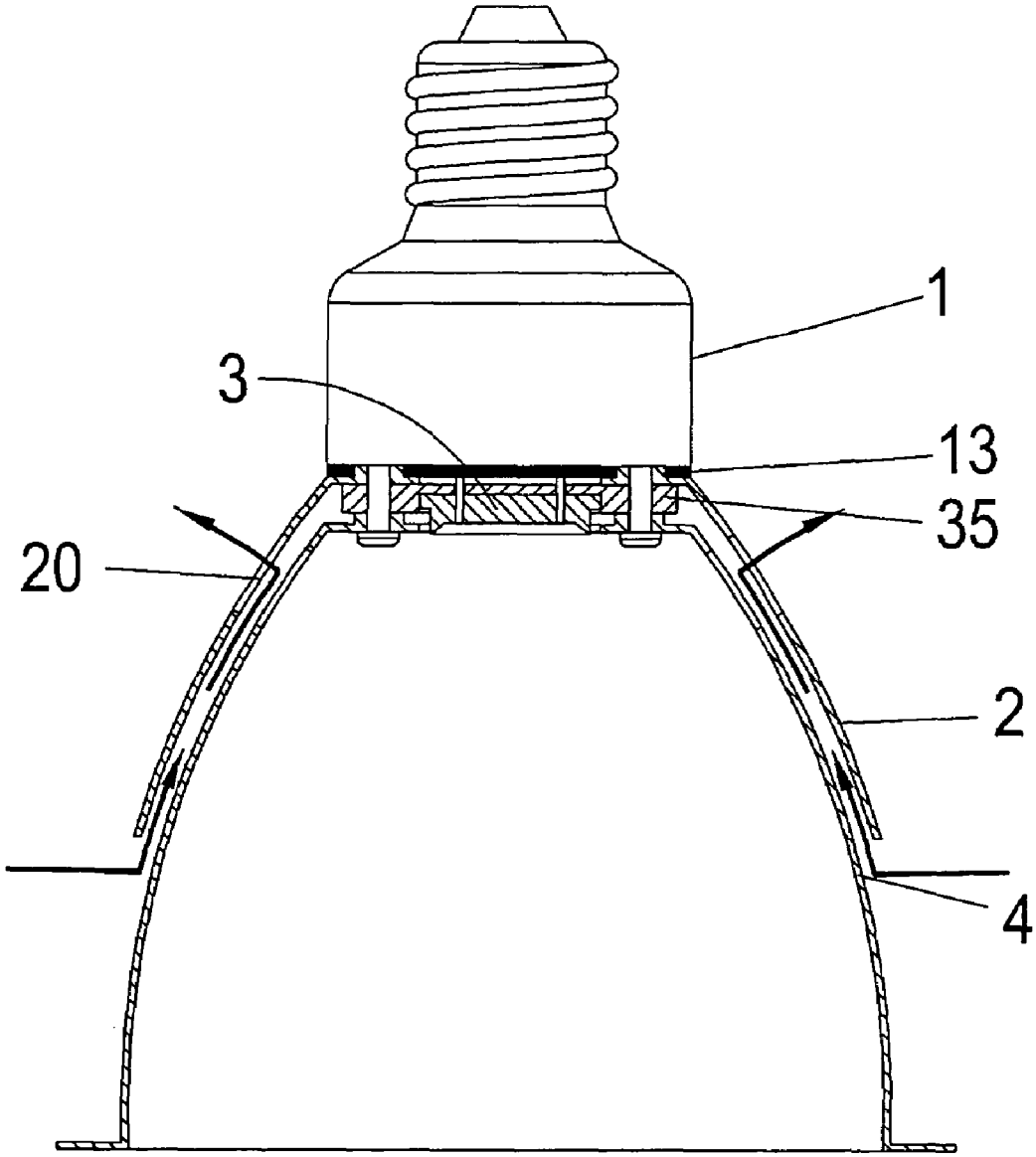
FIG. 6 is a cross sectional view of another embodiment of the present invention.

Referring to FIG. 6, the structure of the present invention can match the length of the auxiliary heat dissipating casing 2 so as to have a desired shape and the assembly work can be performed easily and quickly.

Figure 7:
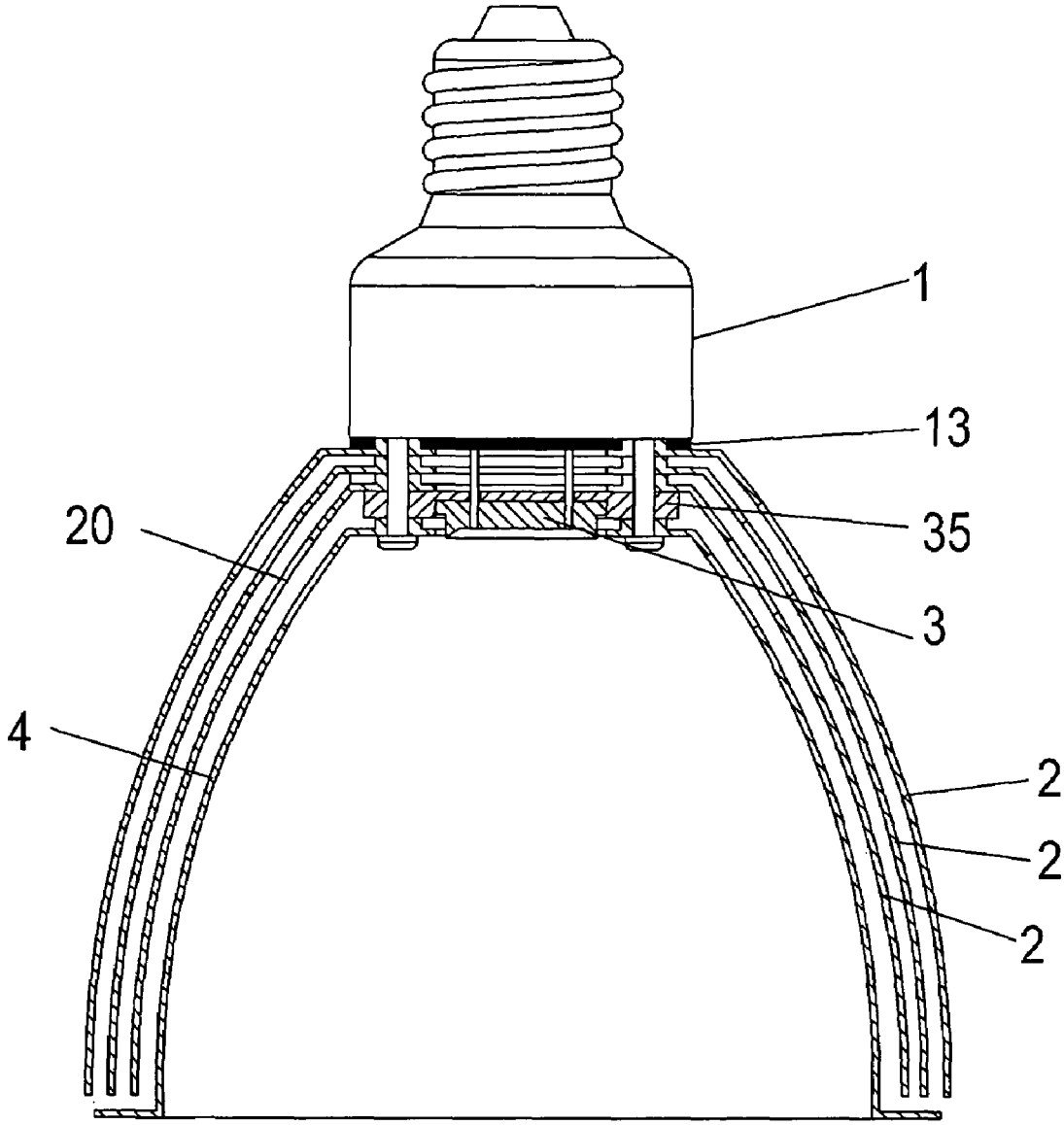
FIG. 7 is an assembled cross sectional view showing that the layer can be increased as desired.

Referring to FIG. 7, it is illustrated it is illustrated that there are plurality of other auxiliary heat dissipating casings 2 installed between the main heat dissipating casing 4 and the auxiliary heat dissipating casing 2 near the main heat dissipating casing 4 or the auxiliary heat dissipating casing 2 so as to increase the heat dissipation ability.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An LED lamp with reflecting casings; comprising:

a bulb seat (1) having a threaded connection (11) at an outer side thereof; an interior of the bulb seat (1) having a power supply (12); the bulb seat (1) having a plurality of hollow posts (14) and the wires connected to a circuit board and protruding outwards;

the auxiliary heat dissipating casing (2) having a hollow tapered shape which is opened at two ends; an upper opening (21) of the auxiliary heat dissipating casing (2) being enclosed by an auxiliary inwardly extending edge (22); the auxiliary inwardly extending edge (22) being formed with a plurality of first connecting holes (24);

an insulating layer (13) installed between an lower end of the bulb seat (1) and the auxiliary heat dissipating casing (2) for isolating the power supply (12) and an auxiliary heat dissipating casing (2);

a main heat dissipating casing (4) being a hollow tapered shape and being opened at two ends; a tapered size of the main heat dissipating casing (4) being smaller than that of the auxiliary heat dissipating casing (2) to cause that the main heat dissipating casing (4) can be received in an interior of the auxiliary heat dissipating casing (2); an upper opening (41) of the main heat dissipating casing (4) having a main inwardly extending edge (42) which is formed with a plurality of second connecting holes (44);

an LED lamp body (3) having a thermally conductive metal heat sink (31) at an upper side thereof; an inner supporting surface (32) of the LED lamp body (3) serving to install with at least one LED chip (33); the metal heat sink (31) having a round shape and a rear end thereof protruding with chip pins (36); and a heat conducting base (35) for receiving the LED lamp body (3); the heat conducting base (35) having plurality of third connecting holes (34); a center of the heat conducting base (35) being installed with a round recess (351); the recess (351) being formed with a plurality of pin holes (352);

wherein in installation, the insulating layer (13) installed between an lower end of the bulb seat (1) and the auxiliary heat dissipating casing (2); the chip (33) is firmly secured to a rear end of the heat conducting base 35 by the chip pins (36) to enter into the pin holes (352) of the heat conducting base (35); and then the heat conductive base (35) is received between the main heat dissipating casing (4) and the auxiliary heat dissipating casing (2); a plurality of screws passes through the plurality of first connecting holes (24) of the auxiliary heat dissipating casing (2), the plurality of third connecting holes (34) of the heat conducting base (35) and the plurality of second connecting holes (44) of the main heat dissipating casing (4) sequentially and then the screws screw into the hollow posts (14) of the bulb seat (1) so as to complete the assembly of the LED lamp.

2. The LED lamp with reflecting casings as claimed in claim 1, wherein a plurality of other auxiliary heat dissipating casings are installed between the main heat dissipating casing and the auxiliary heat dissipating casing near the main heat dissipating casing so as to increase the heat dissipation ability.

3. The LED lamp with reflecting casings as claimed in claim 1, wherein a plurality of other auxiliary heat dissipating casings are installed between the main heat dissipating casing and the auxiliary heat dissipating casing near the auxiliary heat dissipating casing so as to increase the heat dissipation ability.

* * * * *